US009227104B2

(12) United States Patent
Landis

(10) Patent No.: US 9,227,104 B2
(45) Date of Patent: Jan. 5, 2016

(54) JAW AND FACIAL MUSCLE EXERCISING DEVICE

(71) Applicant: Miles Landis, Seattle, WA (US)

(72) Inventor: Miles Landis, Seattle, WA (US)

( * ) Notice: Subject to any disclaimer, the term of this patent is extended or adjusted under 35 U.S.C. 154(b) by 24 days.

(21) Appl. No.: 14/080,602

(22) Filed: Nov. 14, 2013

(65) Prior Publication Data

US 2015/0133269 A1 May 14, 2015

(51) Int. Cl.
*A63B 21/00* (2006.01)
*A63B 23/03* (2006.01)

(52) U.S. Cl.
CPC ..... *A63B 23/032* (2013.01)

(58) Field of Classification Search
CPC ..... A63B 21/00
USPC ..... 482/10, 11
See application file for complete search history.

(56) References Cited

U.S. PATENT DOCUMENTS

| | | | | |
|---|---|---|---|---|
| 8,205,618 | B2 * | 6/2012 | Berghash et al. | 128/861 |
| 8,702,569 | B2 * | 4/2014 | Martin et al. | 482/11 |
| 2009/0272387 | A1 * | 11/2009 | Spencer | 128/848 |
| 2012/0231932 | A1 * | 9/2012 | Rafih et al. | 482/11 |

* cited by examiner

*Primary Examiner* — Jerome w Donnelly
(74) *Attorney, Agent, or Firm* — Lowe Graham Jones PLLC

(57) ABSTRACT

A jaw exercise device includes a generally arcuate central elastomer plate with generally planar surfaces in opposed relationship. The planar surfaces have a plurality of protuberances depending therefrom; each protuberance being generally cylindrical in shape with each having an axis oriented to be perpendicular to the generally planar surface from which it depends. Each protuberance has protuberance walls, the walls having a protuberance height between a protuberance crown and a protuberance base. Two arcuate U-shaped channels are configured each to receive teeth of one of an upper or lower jaw of the user, within the channel. Each U-shaped channel defines a plurality of receptacles. Each receptacle located in a manner to receive, when urged into mating engagement with the central elastomer plate, a corresponding one of the protuberances.

20 Claims, 4 Drawing Sheets

JAW AND FACIAL MUSCLE EXERCISING DEVICE

FIELD OF THE INVENTION

In a field of dental appliances, a jaw exercising device relies upon compressive deformation of elastomeric protuberances.

BACKGROUND OF THE INVENTION

Temporomandibular joint disorder, more commonly known as TMJ, is a condition that affects the joint that opens and closes the mouth. The temporomandibular joints, located in front of the ears, attach the lower jaw to the skull and control mouth movement. This painful disorder can affect either the joint or muscles that surround it. The most common symptoms of TMJ are pain or loss of movement in the jaw, earache, headache, popping noises when opening and closing your mouth, facial pain and dizziness, among others. Exercising one's jaw increases blood flow and oxygen to the joint and muscles, helping to rejuvenate them.

Additionally, athletes have long included jaw exercise in their workout regimens. However, facial muscle tone shouldn't be overlooked. Boxers, football players and other contact sport athletes do so to prevent knockouts and concussions by building a more muscular sheath surrounding the skull. In that same vein, toned jaw muscles help tighten one's facial skin and to better define the jawline. The condition of jaw muscles also known to impact the ability to eat harder foods without discomfort or strain. Additionally, use of training equipment on the jaw, especially compressive equipment has been linked to increased blood flow in the gums and, possibly, a consequent resistance to gingivitis.

To this end, inventors have developed jaw exercise equipment to provide resistive training to muscles. One such device is the "Device for Strengthening the Gums" filed by Mr. K. Kuhn on Jul. 18, 1927 and on May 21, 1929 receiving U.S. Pat. No. 1,714,029 directed to a device including two plates, "spread asunder by spring-pressure and designed to take up chewing pressure." Separated by a helical spring set inside of a pivoting hinge, the plates provide a yielding resistance against which the user can assert pressure using the jaw muscles. Unfortunate positioning of the spring at the opening of the mouth has resulted in users pinching lips and tongues.

U.S. Pat. No. 1,851,865 issued to Mr. P. G. Ptacek on Mar. 29, 1932 seeks to eliminate the helical spring in favor of a U-shaped leaf spring, serving both as a resilient member and as the hinge as opposed to the Kuhn arrangement, Having a rubber lined channel for each of the upper and lower jaws of teeth, the Ptacek device enjoys the additional benefit of allowing fore and aft adjustment of the channel to receive the lower teeth moving the lower jaw either into and out of the mouth to adjust occlusion.

The first all elastomeric device of note in this field is not for exercising but for protecting teeth from impact for such as "boxers, football players, and others engaged in sports or other pursuits, to prevent injury to the lips and teeth, and to prevent the user from becoming unconscious or damaged as a result of a blow to the jaw"; so it is that James B. Poindexter describes his invention in U.S. Pat. No. 2,192,558 issued on Mar. 5, 1940 for a "Tooth Guard and Jaw Protector." The device was a formed block of vulcanized rubber to receive the teeth of the upper and lower jaws being capable of "sufficient yielding to prevent damage to the cusp and crown portions of the teeth [and to] positively hold and retain the teeth in interlocking relation." The guard was only helpful so long as the athlete could breathe sufficient volumes of air through the nose, as it had no means for air to enter or leave the mouth.

Elastomer made the transition from mere protective packing material to the resilient member in a jaw exercising device at the hands of John H. Morris in his Jul. 15, 1941 patent for a "Tooth and Gum Exerciser." The tooth and gum exerciser comprised a body "of substantially H-shaped cross-section . . . and arcuate longitudinal countours . . . to fit one half of the mouth from the front to the rear and to embrace both the upper and lower teeth and gums on that side of the mouth . . . . The device is formed of rubber or other resilient material." Formed as a half mouth dam, the device did not prevent user respiration and is generally regarded as advancement in the art.

Victor H. Carpenter added respiration ports in the monolithic block of Dr. Poindexter to create the "Tooth Guard" U.S. Pat. No. 2,521,039 issued on Mar. 16, 1949 teaches. Incorporating the H-shaped arcuate channel of Morris, the Carpenter Tooth Guard had, as its object, "to provide in a guard of this type, adequate passageways for flow of air to the lungs of the wearer in breathing, and to prevent closing of the wearer's jaws sufficiently to close the passageways."

In the last fifty years, such advances as have been made relate principally to the employment of materials rather than vulcanized rubber. A good example of this substitution of elastomers for the vulcanized rubber of the forties is the "Interocclusal Appliance and Method" described in U.S. Pat. No. 8,316,859 to Frank M. Lesniak issued on Nov. 27, 2012. The abstract asserts, "[a]n interocclusal appliance is formed from a single polymer material composition as one unitary piece or from multiple polymer material compositions as a two-piece preform. The two-piece preform includes a base material and an impression material that has a softening point lower than the base material. Teeth are received into the heat-softened impression material, so as to contour the impression material. A portion of the impression material also may contour to a portion of the user's palate. In certain embodiments, substantially no polymeric material contacts the front surfaces of the front teeth, leading to greater comfort and better air flow between front teeth. In still another embodiment, the appliance fits over front teeth only and no polymeric material contacts the maxillary molars.

Isometric exercise or isometrics are a type of strength training in which the joint angle and muscle length do not change during contraction (compared to concentric or eccentric contractions, called dynamic/isotonic movements). Isometrics are done in static positions, rather than being dynamic through a range of motion. Unfortunately, the elastomeric devices do little more provide the opportunity for isometric exercise as the user compresses a thin layer of elastomer, resulting in development of the muscles of the jaw only at a single point of extension or flexure and fails to work muscles through a range of motion. Only the Kuhn and Ptacek devices are able to present resistance through a range of motion. These, however, suffer from other inadequacies due to their geometries and spring arrangements that simply afford more dangers of harm than promise of tone and strength. What is missing in the art is a true jaw exerciser provided a range of resistance in isotonic exercise of the muscles of the jaw.

SUMMARY OF THE INVENTION

A jaw exercise device includes a generally arcuate central elastomer plate with generally planar surfaces in opposed relationship. The planar surfaces have a plurality of protuberances depending therefrom; each protuberance being generally cylindrical in shape with each having an axis oriented to be perpendicular to the generally planar surface from which it depends. Each protuberance has protuberance walls, the walls having a protuberance height between a protuberance crown and a protuberance base. Two arcuate U-shaped channels are configured each to receive teeth of one of an upper or lower jaw of the user, within the channel. Each U-shaped channel defines a plurality of receptacles. Each receptacle located in a manner to receive, when urged into mating engagement with the central elastomer plate, a corresponding one of the protuberances.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Elastomeric springs are distinct from helical springs in that they possess different spring rates for forces applied in different directions, and can be molded in a shape to fit a particular available space, and can provide some damping. In any elastomeric spring design, deflection occurs in two modes; the first is simple shear and the second is compression. By judicious selection of materials geometry and dimensions, cylindrical elastomeric springs can produce distinct and varied spring rates in axial and radial directions.

Figure 1:
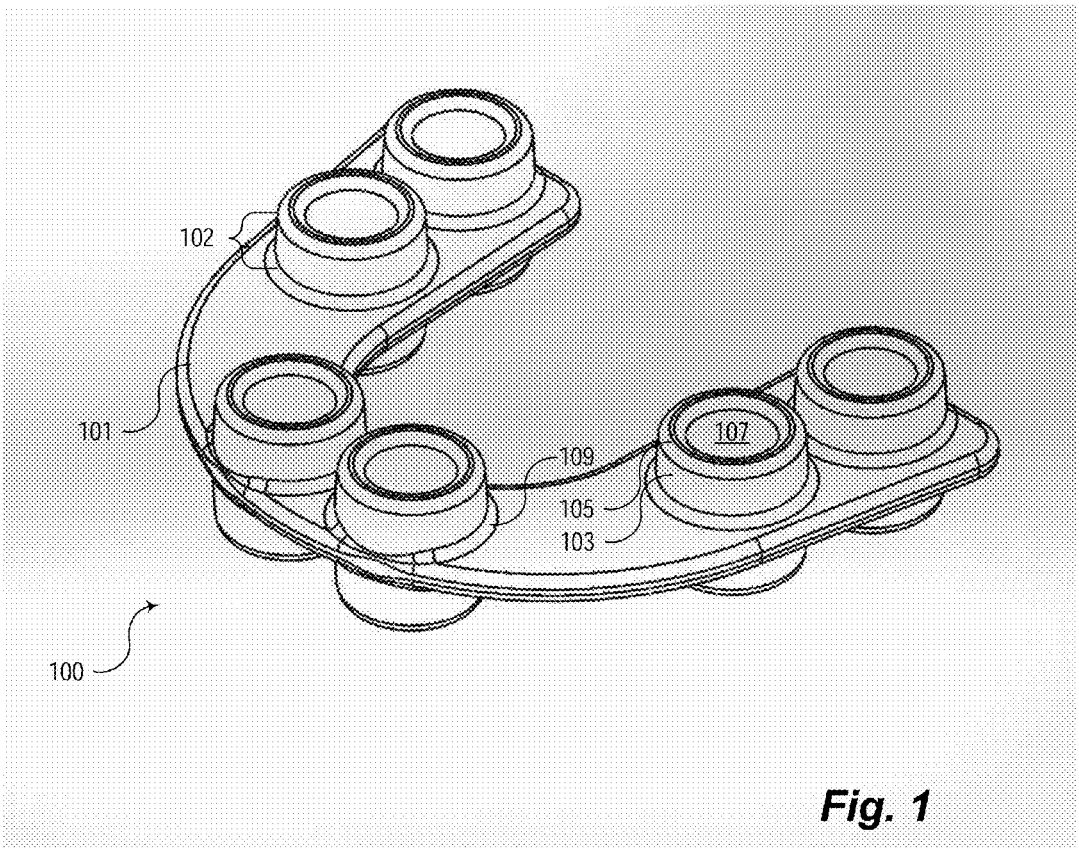
FIG. 1 depicts, in perspective view, a central elastomer plate from which protuberances depend for engaging receptacles.
Figure 2:
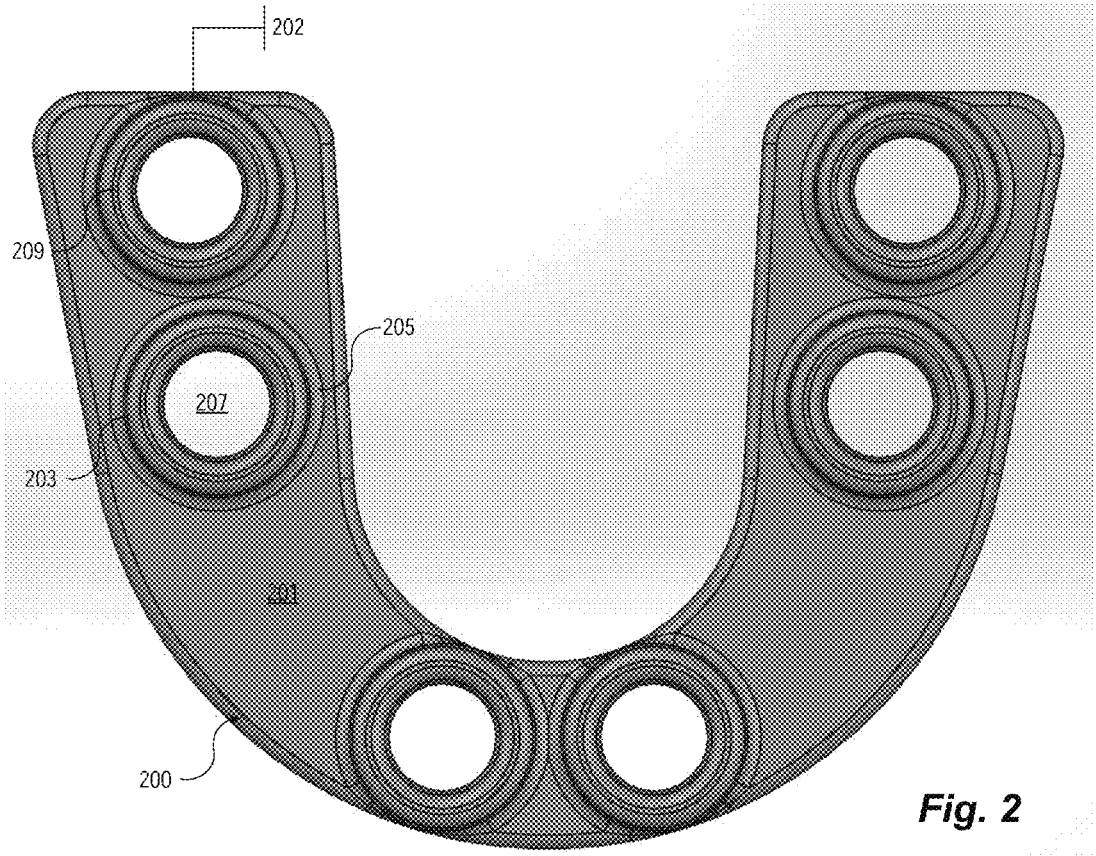
FIG. 2 depicts, in plan view, one of two mating surfaces by which each of a channel for receiving on of an upper or a lower jaw matingly engage the central elastomer plate.

Consider, for instance, the geometry of a central elastomeric plate 100, as depicted in FIG. 1, employed in the inventive jaw exerciser. Consider, as well, a mating surface on each of an upper and a lower channel 200, each having a U-shaped cross-section to suitably engage a User's teeth. FIG. 2 is a plan view of each of an upper or lower channel 200 each having a mating surface 201 exterior to the base of the U; the view being selected to remove from that view those aspects of the channel 200 that might confuse the reader in discerning the geometry of the two mating surfaces 201 prior to engagement with the central elastomer plate 100. In a preferred embodiment, these U-shaped channels 200 would be monolithic, formed from a single polymer material composition as one unitary piece or from multiple polymer materials to include a base material and an impression material that has a softening point lower than the base material.

Geometry of the central elastomer plate 100 in mating engagement with each of the two mating surfaces 201 yields the unique properties and discrete variability of the directional spring rates. Because compressed elastomer springs deform not only in the direction of the compressive force but also perpendicularly, i.e. "bulging," to mount a elastomer spring in a tube sheathing the spring, uniquely tunes the response of the elastomer spring to each of compressive and shearing forces, i.e. forces along an axis of compression (axial) and forces perpendicular to that axis (radial). This geometry allows selection of specific and unique spring rates in the plane parallel to the central elastomer plate 100 (and, as a consequence, parallel as well to each of the two mating surfaces 201) as distinct from that compressive rate applied perpendicularly to the central elastomer plate 100. Specifically, the cylindrical male protuberances 102 depending orthogonally from a substantially planar arcuate plate 101, act as springs, attachment means (in a similar manner to a male and female elements of a snap fastener) and provide positive registration for symmetrically disposed channels.

The central elastomer plate 100 includes, in the preferred embodiment, six protuberances 102 which, when connected to the upper and lower channels 200, extend into the female receptacles 202 which, themselves extend orthogonally from the mating surface 201. The male protuberances 102 extending into the female receptacles 202 in nesting engagement provide a secure connection between each of the mating surfaces 201 and the central elastomer plate 100 in a manner in a passing similarity to the canonical LEGO™ blocks which blocks have "female" indentations on the lower surface, and "male" bosses or protrusions on the upper surfaces.

Unlike the LEGO™ blocks, however, the round protuberances 102 and the corresponding female receptacles 202 are selected to be formed of an elastomeric material which has very specific moduli for stress and compression and these moduli can be varied to give distinct values for spring rates that are compressive or orthogonal to the substantially planar arcuate plate 101 and sheer spring rates in a direction parallel to the surface of the substantially planar arcuate plate 101.

Selective formulation of the elastomeric material alters the expected resilient characteristics of the device and, thus, judicious formulation of the resins that form the central elastomeric plate 100 facilitates tailoring of the compressive force necessary to deform the protuberances 102. Selection of both the material that defines the orifice 207 and that of the protuberance 102 itself will yield a spring rate suited to the exercise function of the device in a manner not available in conventional elastomeric sprung devices.

Occlusion refers to the manner in which the upper and lower teeth come together when the mouth is closed. The mating of the male protuberances 102 in nesting engagement with the female receptacles 202 provides registration between the upper and lower channels and therefore assures proper occlusion between the jaws. Indeed, a measured displacement of the receptacles 202 relative to the protuberances 102 might be used to correct occlusion. In any regard, the forces acting parallel to the plate which might cause malocclusion are suitably resisted by the nesting engagement of the protuberances 102 within the receptacles 202 allowing selection of relatively thin receptacle walls 203 extending from a crown 209 to a base 205 and defining an orifice 207 to influence the compressive spring rate of the protuberance 102 by constricting bulging of the protuberance 102. The receptacle wall 203 has a receptacle height that can be varied to match a height of a corresponding protuberance wall 103, thereby preventing the protuberance 102 from extending through the orifice 207 into either of the upper and lower U-shaped channels 200 when engaged with the central elastomer plate 100.

As stated above, the geometry is particularly important for varying the compressive spring rate. To contrast with the conventional mouth guards such as that taught by U.S. Pat. No. 8,316,859 to Frank M. Lesniak, the shear force (i.e. the force necessary to push the upper and the lower channels 200 out of registration is fairly small and is calculated as shear of a flat sandwich expressed as Ks=G*A/t=F/

$$A=L*W$$

G has values of 70 to 200 psi.

And, the compressive force necessary to deform a sheet of elastomer is calculates the compression of a flat sandwich:

$$Kc=Ec*A/t=F/$$

$$A=L*W$$

Importantly, Ec is dependent on shape factor, which is a measure of how much restraint there is on the part to allow the elastomer to move or "bulge". Thus, a sheet of elastomer has an equation for compression Ec=Eo(1+2 kS^2) where Eo=Youngs Modulus (typically 4.5G-71 approximately). Where:

$$S=\text{Shape}$$

$$\text{Factor}=L*W/2(L+W)t$$

$$K=\text{numerical factor}=0.444+(23.3/G)$$

This calculation for compression spring rate holds true to 10% strain, at which time the spring rate becomes non-linear. Non linearities can be approximated by:

$$F=Ec*A*(/T)(1+/T)$$

Considering the problem further, if the receptacle walls 103 are absent, the shear force attributable to the geometry of the protuberances 102 alone is expressed as the shear of a circular sandwich:

$$Ks=F/=G*A/T$$

$$A=(Ro^2-Ri^2)$$

G—Shear Modulus
A—Load Area
T—Elastomer Section Thickness

Because of the diminished area that the protuberances 103 occupy relative to a whole sheet of elastomer (An apt analogy might be similar to Christmas cookies cut from a sheet of cookie dough. Removing the dough between the cookies makes them much more vulnerable to being deformed by a swipe of a hand than when they are in the sheet of dough.) but such a force is still usable in preventing malocclusion of the U-shaped channels 200.

Interestingly the compression spring rate of circular flat sandwich is not as severely diminished as the shear force.

$$Kc=F/=Ec*A/T$$

$$A=(Ro^2-Ri^2)$$

$$Ec=Eo(1+2kS^2)$$

$$S=\text{Shape Factor}=\text{Load Area/Bulge Area}=(Ro^2-Ri^2)/2(Ro+Ri)T=(Ro-Ri)/2T$$

$$\text{Eo}=4.5\text{G-71 Approximately}$$

$$k=0.444+23.3/G$$

G—Shear Modulus
Ec—Compression Modulus
A—Load Area

It is the addition of the girdling forces presented by the receptacle 202 nestingly engaging the protuberance 102 within the orifice 207 that gives the whole assembly the central elastomer plate 100 in mating engagement with each of the two channels 200 that make up an engineering situation that is expressed as a tubular mount. Immediately the virtue of this engaging geometry is demonstrated both in shear and in compressive forces necessary to deform the protuberances 102. This shear force is expressed as $$Ks=F/=2.73*G*L/\log 10(D/d)$$

More important to the distinction between the instant invention and conventional sheet elastomeric is the compressive forces to deform the tubular mount in compression:

$$Kc=F/=Ec*A/T$$

$$A=L*Di$$

$$Ec=Eo(1+2kS^2)$$

$$S=2*L*Di/(Do+Di)T$$

$$Eo=4.5*\text{G-71 Approximately}$$

$$K=0.444+23.3/G$$

The calculation of tubular mount compression rate may very approximate due to variability in the tension side of the mount i.e. the receptacle 102 orifice 207 which can be modified by mold pressure and post molding processing.

The virtue of the protuberance 102 when nestingly engaged in the orifice 207 of the female receptacle 201 is that the compressive force that can be exerted is both specifically controlled by selecting a diameter of the protuberance 102 across its plateau 107. Because there is a far greater differential between the shear force and the compressive force, selection of dimensions especially a height of the protuberance 102 and its diameter can be tailored to yield specific compressive forces necessary to drive the jaw through a range of compression selected by the designer. In a similar manner, materials for the central elastomeric plate 100 can be selected with varying Young's moduli in the several formulations of the elastomer in order to give a range of forces so that the User can select a compressive force much as a weight lifter can add plates to the bar when, for example, performing a bench press to enhance or diminish the force necessary to lift the bar.

In a preferred embodiment, the central elastomeric plates 100 are formed with distinct dye formulations indicative of compressive forces necessary to deform the protuberances 102. By way of nonlimiting example, Red plates are used to indicate the plates having the highest durometer (hardness or resistance to permanent indentation) within a collection of central elastomeric plates 100; Orange is slightly less hard; Yellow even less hard; and so forth; extending that same convention through Green, Blue, Indigo, culminating in the least hard, the beginner's plate—Violet.

To enhance the effect provided by the nesting engagement of the protuberances 102 and the receptacles 202, a receptacle crown 209 is formed with a curved profile that corresponds with a protuberance base 109, while the protuberance 102 has a protuberance crown 105 whose profile snugly contours to the profile of the receptacle base 205. In this manner, the protuberance is engaged snugly along its entire protuberance height.

Figure 3:
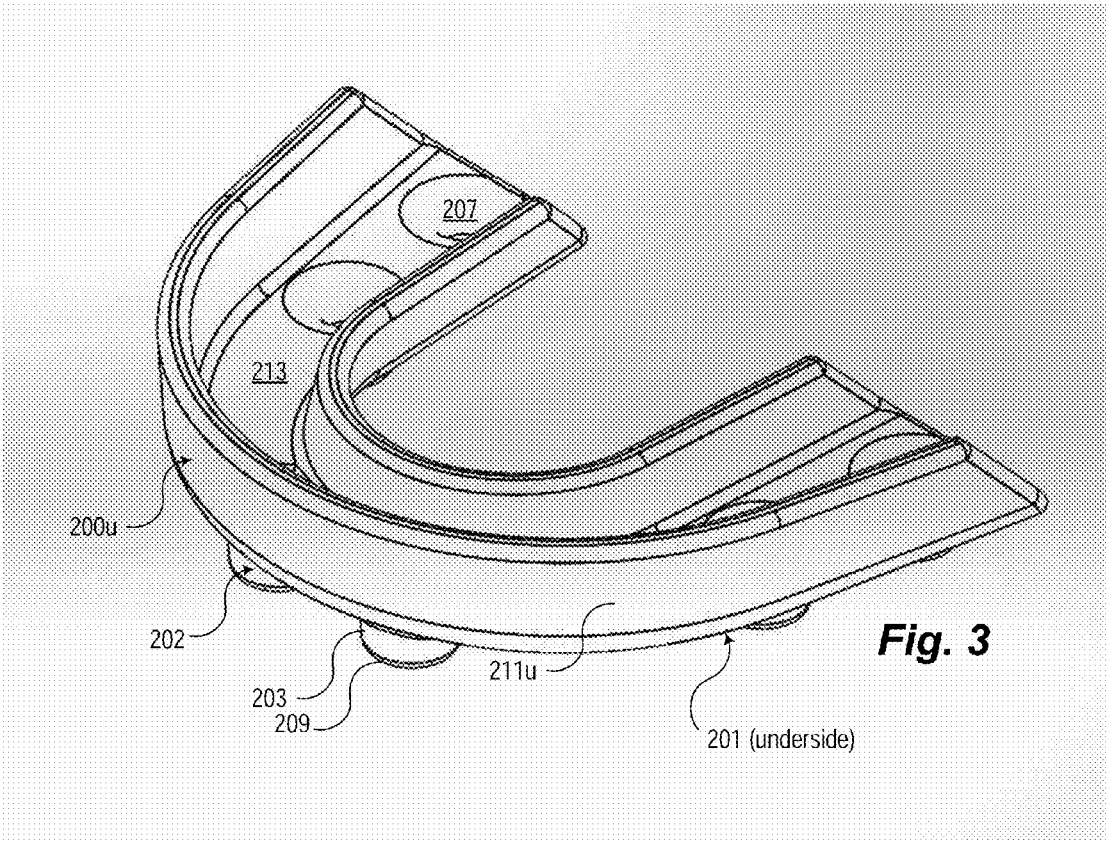
FIG. 3 depicts, in perspective view, the channel for receiving the upper jaw.

To give further context to the reader, FIG. 3 depicts only the upper channel 200*u*, this time in perspective view rather than the constructed plan view of FIG. 2. As previously shown in FIG. 2, the upper channel 200*u* has a mating surface 201 which in this view is portrayed on the underside of the channel 200. Also visible are the protuberances 202, each having a protuberance height between a protuberance base (not shown) and a protuberance crown 209. Also visible in this view is the surface 211*u* which is formed into the arcuate U-shaped channel 200*u*.

In a preferred embodiment, an inner surface of the U-shaped channel 200*u* is formed of an impression material having a melting point of between 35° C. and 100° C. The surface, on the other hand, comprises material having a melting point in excess of that of the impression material, thereby to allow differential molding of the impression material without molding the channel. In use, the whole of the U-shaped channel is heated to a temperature to drive the impression material 213 to a softened state such that the impression material 213 becomes susceptible to formation under a biting pressure by the User at a temperature selected to soften the impression material 213 without simultaneously burning the gums of the User in making that impression. After biting the impression material 213 in its softened state, the User then withdraws his teeth and allows the impression material 213 to cool and, thereby, to harden. Once formed, the impression material 213 will suitably cradle the User's teeth when in use to effectively spread stresses of compressive exercise across the User's jaw preventing any one tooth from bearing an undue amount of the compressive force. the User exerts in exercise. While FIG. 3 only depicts the upper channel 200*u*, all descriptions of the upper channel 200*u* apply with equal vigor to the lower channel 2001 as they are symmetrically disposed about the central elastomer plate 100, when in use.

Figure 4:
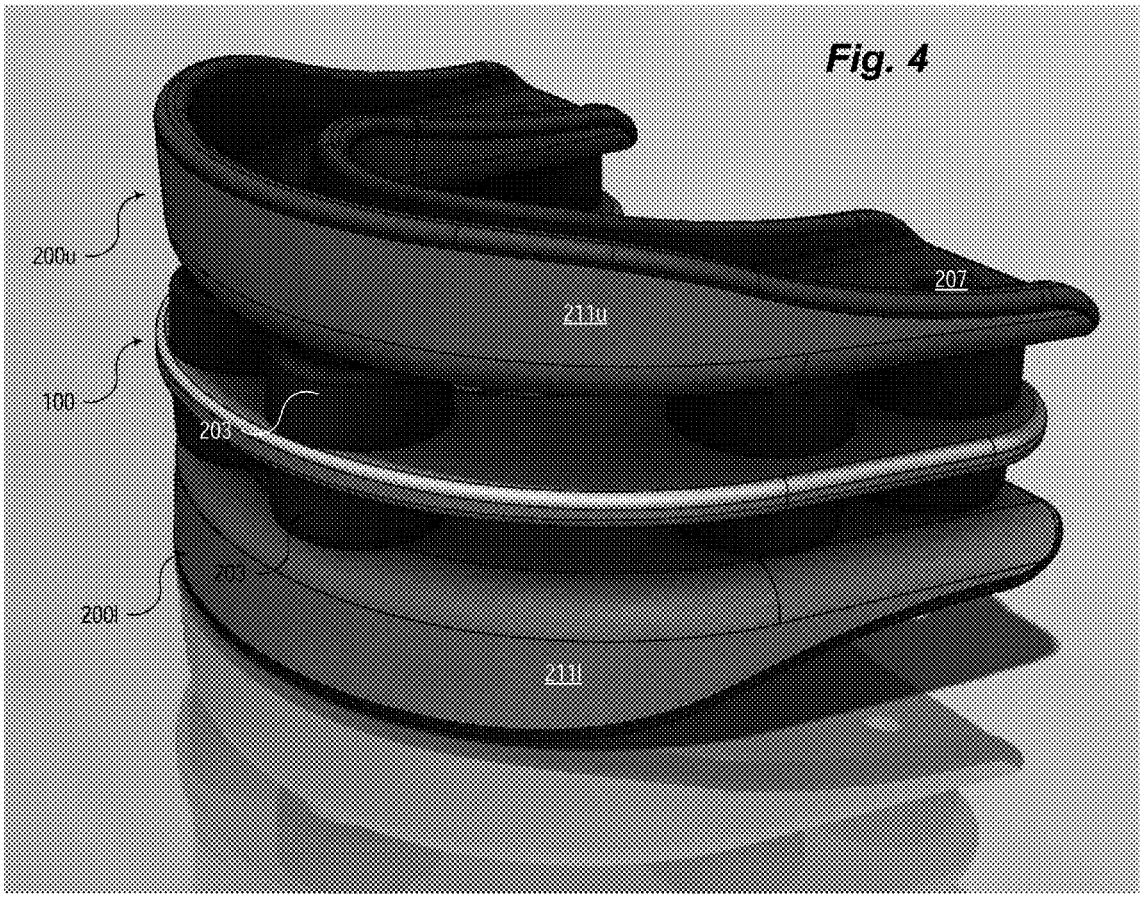
FIG. 4 depicts an assembled jaw exercising device including the central elastomer plate and each of the channels for receiving the upper and the lower jaws, respectively.

FIG. 4 depicts the inventive exercise device in its configuration for use. Arrayed about the central elastomer plate 100 are the upper channel 200*u* and the lower channel 2001 engaged by means of the arrayed protuberances (not shown) being received in the receptacles 203 the channels define. In this configuration, a User will readily find the exercise device to be intuitive and capable of receiving compressive forces evenly across the jaw to exercise the jaw muscles through the longest range of motion possible in a readily positionable compressive jaw exerciser.

The elastomer springs that the protuberances 102 and receptacles 202 form in cooperation as located by the protuberances 102 as they depend from the central elastomer plate 100. As explained above, interchangeable central elastomer plates 100 each having their distinct compressive ratings can, optionally, as selected, can tailor a workout for optimal effective exercise of the jaw and facial muscles.

While the preferred embodiment of the invention has been illustrated and described, as noted above, many changes can be made without departing from the spirit and scope of the invention. Importantly, the receptacles can be equally well defined in the central elastomeric plate 100 to receive protuberances 102 depending from each of the upper and lower channels 200 without departing from the invention. There is nothing essential about the arrangement or number of these corresponding pairs of protuberances and receptacles except that for each protuberance there is a corresponding receptacle to form a mating connection. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A jaw exercise device comprises:

a generally arcuate central elastomer plate with generally planar surfaces in opposed relationship having a plurality of protuberances depending therefrom on each of the two generally planar surfaces, each protuberance being generally cylindrical in shape with each having an axis oriented to be perpendicular to the generally planar surface from which it depends, the protuberance having protuberance walls, the walls having a protuberance height between a protuberance crown and a protuberance base;

two arcuate U-shaped channels configured each to receive teeth of one of an upper or lower jaw of the user, each U-shaped channel defining a plurality of receptacles, each receptacle located in a manner to receive, when urged into mating engagement with the central elastomer plate, a corresponding one of the protuberances.

2. The device of claim 1, wherein:

the central elastomer plate is selected from a plurality of central elastomer plates each of the plurality being configured to conform to the same geometric configuration but having distinct durometer.

3. The device of claim 2, wherein:

each of plurality is formed of an elastomer comprising dyes to color the central elastomer plate, the dyes being selected to give each of the plurality a distinct color selected to represent the durometer of the central elastomer plate.

4. The device of claim 1, wherein the arcuate U-shaped channels are formed to include an elastomeric surface to define the U-shaped channel.

5. The device of claim 4, further comprising an impression material overmolding at least the interior of the U-shaped channel across its base and having the ability to be formed to receive teeth of a User's jaw, the jaw being selected from a group consisting of an upper and a lower jaw.

6. The device of claim 5, wherein the impression material has a melting point at a temperature between 35° C. and 100° C. and the surface material has a melting point in excess of that of the impression material.

7. The device of claim 1, wherein:

the receptacle includes a receptacle crown, a receptacle base, and a receptacle wall spanning the orifice height between the receptacle crown and receptacle base and defining an orifice;

the protuberance includes a protuberance crown, a protuberance base, and a protuberance wall spanning the protuberance height between the protuberance crown and the protuberance base; and wherein a profile is selected such that the protuberance crown engagingly contacts the receptacle base, the protuberance wall engagingly contacts the receptacle wall and the receptacle crown engagingly contacts the protuberance base.

8. The device of claim 7, wherein the durometer of the protuberance and the resistance to strain of the receptacle are selected to control the protuberance bulge upon compressive deformation and thereby yield a specific compressive resistance along a curve throughout a range of motion.

9. A central elastomer plate for a jaw exercising device which includes two arcuate U-shaped channels, each channel configured to receive teeth of a User's jaw, the jaw being selected from a group consisting of an upper and a lower jaw:

the generally arcuate central elastomer plate having generally planar surfaces in opposed relationship having a plurality of protuberances depending therefrom on each of the two generally planar surfaces, each protuberance being generally cylindrical in shape with each having an axis oriented to be perpendicular to the generally planar surface from which it depends, the protuberance having protuberance walls, the walls having a protuberance height between a protuberance crown and a protuberance base, the plurality of protuberances being configured to be received into a plurality of receptacles the U-shaped channels define, each receptacle located in a manner to receive, when urged into mating engagement with the central elastomer plate, a corresponding one of the protuberances.

10. The plate of claim 9, wherein:

the central elastomer plate is selected from a plurality of central elastomer plates each of the plurality being configured to conform to the same geometric configuration but having distinct durometer.

11. The plate of claim 10, wherein:

each of plurality is formed of an elastomer comprising dyes to color the central elastomer plate, the dyes being selected to give each of the plurality a distinct color selected to represent the durometer of the central elastomer plate.

12. The plate of claim 9, wherein the arcuate U-shaped channels are formed to include an elastomeric surface to define the U-shaped channel.

13. The plate of claim 12, further comprising an impression material overmolding at least the interior of the U-shaped channel across its base and having the ability to be formed to receive teeth of a User's jaw, the jaw being selected from a group consisting of an upper and a lower jaw.

14. The plate of claim 13, wherein the impression material has a melting point at a temperature between 35° C. and 100° C. and the surface material has a melting point in excess of that of the impression material.

15. The plate of claim 9, wherein:

the receptacle includes a receptacle crown, a receptacle base, and a receptacle wall spanning the orifice height between the receptacle crown and receptacle base and defining an orifice;

the protuberance includes a protuberance crown, a protuberance base, and a protuberance wall spanning the protuberance height between the protuberance crown and the protuberance base; and wherein a profile is selected such that the protuberance crown engagingly contacts the receptacle base, the protuberance wall engagingly contacts the receptacle wall and the receptacle crown engagingly contacts the protuberance base.

16. The plate of claim 15, wherein the durometer of the protuberance and the resistance to strain of the receptacle are selected to control the protuberance bulge upon compressive deformation and thereby yield a specific compressive resistance along a curve throughout a range of motion.

17. A method for assembling a jaw exercise device, the method comprising:

providing a generally arcuate central elastomer plate with generally planar surfaces in opposed relationship having a plurality of protuberances depending therefrom on each of the two generally planar surfaces, each protuberance being generally cylindrical in shape with each having an axis oriented to be perpendicular to the generally planar surface from which it depends, the protuberance having protuberance walls, the walls having a protuberance height between a protuberance crown and a protuberance base;

providing two arcuate U-shaped channels configured each to receive teeth of one of an upper or lower jaw of the user, each U-shaped channel defining a plurality of receptacles, each receptacle located in a manner to receive, when urged into mating engagement with the central elastomer plate, a corresponding one of the protuberances.

18. The method of claim 17, further comprising:

urging each of the two U-shaped channels into mating engagement with the central elastomer plate such that the protuberances are matingly engaged with each channel.

19. The method of claim 18, further comprising:

selecting one central elastomer plate, from a plurality of the central elastomer plate is selected from a plurality of central elastomer plates each of the plurality being configured to conform to the same geometric configuration but having distinct durometer.

20. The method of claim 19, wherein each of plurality is formed of an elastomer comprising dyes to color the central elastomer plate, the dyes being selected to give each of the plurality a distinct color selected to represent the durometer of the central elastomer plate.

* * * * *